United States Patent [19]

Tandrup et al.

[11] 4,316,486

[45] Feb. 23, 1982

[54] ELECTROHYDRAULIC CONTROL APPARATUS

[75] Inventors: Niels Tandrup, Nordborg; Alex Petersen, Sonderborg, both of Denmark

[73] Assignee: Danfoss A/S, Nordborg, Denmark

[21] Appl. No.: 125,502

[22] Filed: Feb. 28, 1980

Related U.S. Application Data

[63] Continuation of Ser. No. 19,076, Mar. 9, 1979, abandoned, which is a continuation of Ser. No. 840,383, Oct. 7, 1977, abandoned.

[30] Foreign Application Priority Data

Oct. 9, 1976 [DE] Fed. Rep. of Germany ..... 2645768

[51] Int. Cl.[3] ..... F15B 13/043

[52] U.S. Cl. ..... 137/625.64; 91/459; 91/461; 137/596.16

[58] Field of Search ..... 91/454, 459, 442, 461; 137/625.64, 625.62, 625.63, 596.16, 596.14, 596.15; 251/86, 88

[56] References Cited

U.S. PATENT DOCUMENTS

| | | | |
|---|---|---|---|
| 2,569,881 | 10/1951 | Davies | 91/454 |
| 2,583,185 | 1/1952 | McLeod | 137/596.15 |
| 2,672,731 | 3/1954 | Ashton | 91/454 X |
| 2,687,706 | 8/1954 | Glenny et al. | 91/442 X |
| 2,984,257 | 5/1961 | McCormick et al. | 91/454 X |
| 3,106,219 | 10/1963 | Teston | 251/86 X |
| 3,129,645 | 4/1964 | Olmsted | 137/625.64 X |
| 3,198,203 | 8/1965 | Margida | 251/86 X |
| 3,905,393 | 9/1975 | Hartwig | 137/596.14 |
| 4,058,140 | 11/1977 | Budzich | 91/446 |

FOREIGN PATENT DOCUMENTS

| | | | |
|---|---|---|---|
| 2412318 | 9/1934 | Fed. Rep. of Germany | 91/454 |
| 2258853 | 6/1974 | Fed. Rep. of Germany | 91/454 |

*Primary Examiner*—Irwin C. Cohen
*Attorney, Agent, or Firm*—Wayne B. Easton

[57] ABSTRACT

The invention relates to an electrohydraulic control assembly of the type having a slide valve unit for controlling the operating direction of a hydraulic servomotor. The assembly includes a bridge circuit between the pressure source and the drain tank which has a pressure operated valve in each of its four branches. Diagonally opposite bridge terminals between the supply and exhaust branches of the bridge circuit are connected operating chambers on opposite sides of the slide valve unit. The bridge circuit valves are operated by solenoid valves to achieve selective directional operation of the slide valve unit.

5 Claims, 3 Drawing Figures

ELECTROHYDRAULIC CONTROL APPARATUS

This is a continuation application of application Ser. No. 019,076, filed Mar. 9, 1979, now abandoned, which is a continuation of Ser. No. 840,383 filed Oct. 7, 1977, now abandoned.

The invention relates to an electrohydraulic control apparatus comprising a piston to be actuated, a bridge circuit which has a connection on the pressure side and one on the outlet side, of which the diagonal points are each connected to one pressure chamber of the piston and which in each of its four branches contains a hydraulically operable bridge valve that closes in the presence of the control pressure, and comprising two magnetic valves associated with a respective common control pressure conduit for oppositely disposed bridge valves.

In a known control apparatus of this kind, the closure members of the bridge valves consist of balls held in a guide into which a control pressure conduit opens. In the common control pressure conduit of every two opposed bridge valves there is a magnetic valve which is open in the rest position, i.e. contains the control pressure, and closes on energisation. The bridge valves assume defined positions under the influence of control pressure as well as the operating pressure in front of and behind the valve. On actuation of one magnetic valve, the piston moves in one direction and on actuation of the other magnetic valve it moves in the other direction. If both magnetic valves are energised, the piston rod may be moved freely. If both magnetic valves are in the rest position, the piston rod is blocked.

An electrohydraulic control apparatus is also known in which the piston is biassed by neutral position springs. The pressure chambers are connected to the diagonal points of a bridge circuit which utilises magnetic valves as bridge valves on the outlet side and check valves as bridge valves on the supply side. The piston forms the slide of a hydraulic valve which, in turn, controls a work motor.

The invention is based on the problem of providing an electrohydraulic control apparatus of the aforementioned kind which operates very precisely as a result of positive control of all four bridge valves, therefore has a high degree of reliability and automatically and rapidly goes over to a neutral central position in the absence of electric power.

This problem is solved according to the invention in that the piston is biassed by a neutral position spring arrangement, that the bridge valves on the outlet side are biassed in the opening direction by valve springs, and that the magnetic valves are disposed so that, on energisation, only the associated control pressure conduit is under pressure.

If the current supply ceases in such a control apparatus, the magnetic valves move to their rest position. The control pressure for the bridge valves therefore drops off. The bridge valves on the outlet side consequently open under the influence of the valve springs. The piston pressure chambers are thereby directly interconnected. The piston is rapidly moved to its neutral central position under the influence of the neutral position springs. If no accurate balance of volumes occurs when one of the pressure chambers becomes smaller and the other larger, excess can be discharged through the outlet and any shortcoming can be sucked in through the outlet. Since all four bridge valves can be pressed tightly against the seat under the influence of the control pressure, one obtains very accurate operation and complete shutting off of the pressure chambers of the piston particularly in the blocked condition.

The bridge valves on the supply side can be biassed in the closing direction by valve springs. It is also possible for the bridge valves to comprise differential pistons of which the larger piston area is subjected to the control pressure. Both ways permit the control pressure for closing and for maintaining closure to be kept in a confined space.

This proposal is suitable for all uses in which the neutral position of a piston offers the greatest condition of safety, whether it be the piston of a servo-motor or a control piston for downstream-connected units. It is particularly advantageous if the piston forms the slide of a hydraulic valve which, in the neutral position, separates a downstream work motor from the pressure source.

Desirably, downstream of the connection of the bridge circuit on the outlet side there is a pressure holding device which holds the outlet pressure above atmospheric. Since the piston is rapidly returned to the neutral position under the influence of the neutral position springs, a pressure drop occurs in the enlarged pressure chamber. With the aid of the pressure holding device, one can ensure that the pressure in the pressure chamber does not drop below atmospheric. This makes it more difficult for air to be separated from the pressure fluid.

In particular, the pressure holding device may be formed by a counterpressure valve. This counterpressure valve ensures that the pressure at the connection of the bridge circuit on the outlet side is higher by a predetermined amount than the tank which is under atmospheric pressure.

In this case it is recommended that further outlet conduits are so connected to the pressure holding device that a flow of pressure medium constantly flows through the pressure holding device during operation. The pressure in the intermediate store is therefore permanently sufficiently elevated, that is to say also at the instant of cessation of the current supply. The pressure holding device can even be in the form of a simple throttle.

It is also favourable if provision is made for a pressure regulator which is fed by a pump and to the constant pressure outlet of which the control pressure conduit is connected. The control pressure is then independent of the pump pressure.

Further, it is advisable if the connection of the bridge circuit on the outlet side is associated with a pressure limiting device which holds the supply pressure below a predetermined limiting value. This ensures in a simple manner that limiting closing forces will suffice to keep the bridge valves on the supply side closed.

Such a pressure limiting device may comprise a throttle device upstream of the bridge circuit and an outlet throttle parallel to the bridge circuit. Even in the case of closed bridge valves on the supply side one then obtains a continuous flow of pressure medium which gives rise to a pressure distribution as a result of the pressure drop at the throttle device and the outlet throttle.

In particular, the outlet throttle may be formed by a spring-biassed check valve.

Upon a desired adjustment of the piston, the upstream throttle device has an influence on the speed of the piston. In some cases it is advisable that the upstream throttle device should comprise two throttles in parallel, of which the one is in series with a blocking valve operable by a further magnetic valve. In this way one can set two speed stages for the motion of the piston. This is, for example, of advantage if the speed is reduced shortly before reaching the desired value. In a preferred embodiment, it is ensured that the bridge valves on the supply side are impinged on by the supply pressure in the opening direction on an annular surface which surrounds the valve seat and which is dimensioned so that the bridge valve opens when the control pressure disappears.

It is also favourable if the diagonal points are each connected to the inside of the seat of the bridge valves that is coverable by the closure member. Liquid leading from the control pressure chamber along the valve piston will then not find it possible to adjust the slide piston in the blocking condition.

Further, the bridge valves may comprise balls as closure members which are each mounted in end recesses of valve pistons which can be impinged on by the control pressure. One thereby obtains a piston cross-section which projects as much as is desired beyond the ball cross-section and which will ensure a secure closure even at low control pressures. In addition, the ball provides a particularly tightly sealed closure.

The arrangement of the magnetic valves can be such that the magnetic valve is connected in the associated control pressure conduit and is closed in the rest position, a branch provided with a throttle branching off from the control pressure conduit to the tank behind the magnetic valve. If the magnetic valve closes in the absence of a current, the pressure in the control pressure conduit can rapidly drop off by way of the throttle.

If it is expected that the control pressure conduits will be more often under pressure than not, it is recommended that an alternative solution be employed according to which the magnetic valve is disposed in a branch leading from the associated control pressure conduit to the tank and is open in the rest condition, a throttle being provided in the control pressure conduit in front of the branch.

The invention will now be described in more detail with reference to the example illustrated in the drawing, wherein.

Figures 1, 2, 3:
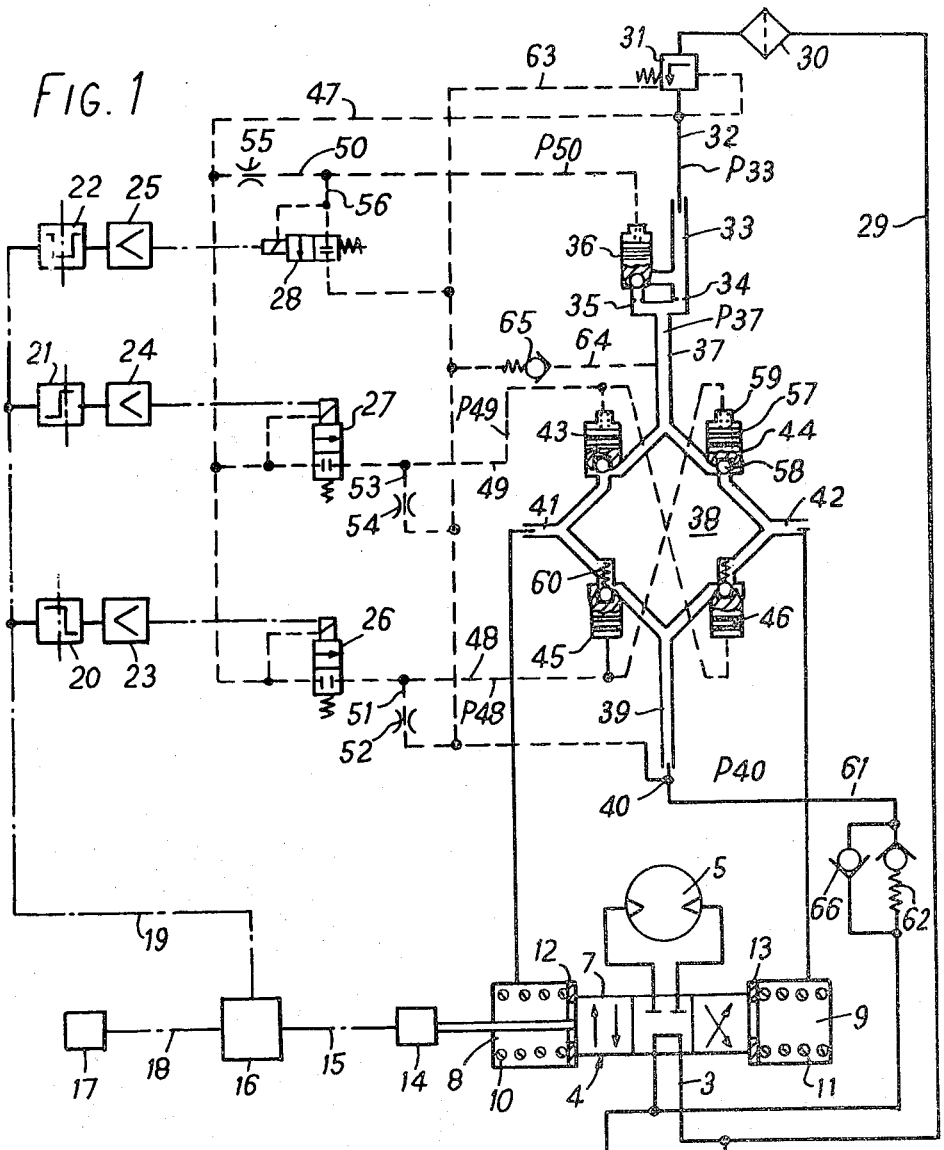
FIG. 1 is a circuit diagram of a control apparatus according to the invention in the form of a proportional valve.
FIG. 2 is a modification of FIG. 1 with regard to the magnetic valve.
FIG. 3 is a modification of the bridge valve on the supply side.

A pump 1 conveys pressure medium from a tank 2 under atmospheric pressure through a pressure conduit 3 and a hydraulic valve 4 to a hydraulic work motor 5 whence the pressure medium returns to the tank 2 through the valve 4 and an outlet conduit 6.

The valve comprises a piston or slide 7 which is part of the control apparatus according to the invention. Each end face is associated with a pressure chamber 8 and 9 in which there are neutral position springs 10 and 11. Abutment rings 12 and 13 ensure that each neutral position spring is effective on only one side of the neutral position.

The existing position of the piston 7 is determined by means of a measuring device 14 and transmitted to a comparator 16 by way of an impulse line 15. A desired value, which may be predetermined by means of a setting device 17, is fed to the comparator by way of an impulse line 18. The output signal of the comparator, namely the control departure, is fed by way of a signal line 19 to three comparators 20, 21 and 22, each of which has a downstream amplifier 23, 24 or 25 and tends to energise a respective magnetic valve 26, 27 or 28. The signal generator 20 gives a current signal as long as the control departure is less than a positive limiting value which is close to zero. The signal generator 21 gives a current signal as long as the control departure is larger than a negative limiting value which is close to zero. The signal generator 22 gives a current signal when the control departure exceeds a predetermined absolute amount.

Branching off from the pressure conduit 3 there is a conduit 29 which leads by way of a filter 30 to a pressure regulating valve 31 at the output 32 of which there is a constant pressure. Connected thereto there is a conduit 33 in which two throttles or diaphragms 34 and 35 are disposed in parallel. The conduit branch with the throttle 35 can be closed by a hydraulically operable valve 36. There follows the supply side connection 37 of a bridge circuit 38 of which the two diagonal points 41 and 42 are connected to the pressure chambers 8 and 9 which have a hydraulically operable valve 43, 44, 45 or 46 in each branch and the connection 39 on the outlet side of which is in communication with a connecting point 40.

Branching off from the outlet 32 of the pressure regulator 31 there is a further conduit 47 leading to three control pressure conduits 48, 49 and 50. The magnetic valve 26 which is closed in the rest position is disposed in the pressure control conduit 48. It leads to the control pressure chambers of the bridge valves 44 and 45. In addition it possesses a branch 51 with a throttle 52 which leads to the connecting point 40. The magnetic valve 27 which is closed in the rest position is disposed in the control pressure conduit 49. It is connected to the control pressure chambers of the bridge valves 43 and 46 and possesses a branch 53 with a throttle 54 which likewise leads to the connecting point 40. A throttle 55 is included in the pressure control conduit 50. It is connected to the control pressure chamber of the blocking valve 36. It also possesses a branch 56 in which there is disposed the magnetic valve 28 that is closed in the rest condition and which also leads to the connecting point 40.

Each hydraulically actuated valve possesses a piston 57 in which a closure member in the form of a ball 58 is held at the front. On the occurrence of a control pressure in the conduits 48, 49, or 50, the associated valves are pressed to the closing position. In addition, all hydraulic valves possess a spring. The springs 59 of the bridge valves 43 and 44 on the supply side are closing springs. They are so dimensioned that they support closing in the presence of the control pressure but, in the absence of the control pressure, permit opening under the influence of the supply pressure. The springs 60 of the bridge valves 45 and 46 on the outlet side are opening springs. They are so dimensioned that they permit positive opening in the absence of the control pressure but, in the presence of the control pressure do not obstruct closing.

The connecting point 40 is connected to the outlet conduit 6 by way of a conduit 61 in which there is a counter pressure valve 62 in the form of a spring-biassed check valve. In this way the pressure P40 is kept above the pressure P2 in the tank. The pressure remains relatively constant because pressure medium is constantly delivered by the pressure regulating valve 31 by way of a conduit 63 as well as the conduit 64 to be described hereinafter and there is therefore a constant flow through the counterpressure valve 62. The counterpressure valve is bridged by an oppositely opening check valve 66.

The supply side connection 37 of the bridge circuit 38 is connected to a spring-biassed check valve 65 towards the connecting point 40 by way of a conduit 64. Consequently there is a constant flow through the conduit 33 and the conduit 64, a pressure drop occurring in the conduit 33 at least at the throttle 34 and in the conduit 64 at the spring-biassed check valve 65. A limited pressure P37 less than the pressure P33 that is being kept constant is therefore always available at the connection 37 on the pressure side.

The control apparatus operates in the following manner:

1. When the magnetic valve 26 is energised, the control pressure conduit 48 has the control pressure P48. The bridge valve 45 on the outlet side is closed. The bridge valve 44 on the supply side is closed under elevated pressure. Pressure medium is supplied to the pressure chamber 8 by way of the bridge valve 43 whereas pressure medium is led away from the pressure chamber 9 by way of the bridge valve 46. The piston 7 is therefore displaced to the right.

2. When the magnetic valve 27 is energised, a control pressure P49 occurs in the control pressure conduit 49 and this influences the bridge valves 43 and 46 so that the piston 7 is displaced to the left.

3. When both magnetic valves 26 and 27 are energised, namely when the control departure is practically zero, all bridge valves 43–46 are held in the closed position by the control pressure P48 and P49. The piston 7 is therefore securely locked in the respective position. The valves 43–46 are leakage-proof because the closure members are pressed against the seat by the control pressure.

4. When both magnetic valves 26 and 27 are not energised, the bridge valves 43–46 have the illustrated position; the bridge valves 43 and 44 on the supply side are open to a larger or smaller extent depending on the size of the force exerted by the spring 59 and the force exerted by the pressure P37 on the annular face around the ball 58. The bridge valves 45 and 46 on the supply side are fully open under the influence of the spring 60. When the piston 7 does not have the illustrated neutral position in a case where the magnetic valves 26 and 27 are de-energised, it is pushed to the illustrated central position by one of the neutral position springs 10 or 11. If, for example, it was displaced to the left, the neutral position spring 10 pushes it to the right, pressure medium displaced from the pressure chamber 9 reaching the pressure chamber 8 by way of the bridge valves 46 and 45. In this case it is permissible for excess pressure medium to be discharged through the counterpressure valve 62 or replenishing pressure medium to be sucked in through the check valve 66. Since the pressure P40 lies above atmospheric, there is during suction no danger that the pressure chamber 8 will be under vacuum and possibly sucking in air.

In this case the piston 7 can also be adjusted manually so that it is possible to lower a load and, if the pressure supply is still intact, also to raise it.

In the absence of current, the magnetic valves 26 and 27 are de-energised; they therefore close immediately. The control pressure P48 can fall of through the throttle 52 and the control pressure P49 through the throttle 54. The piston 7 therefore returns to the neutral position in the above-described manner.

This is also the case in the absence of a pressure supply. The only difference is that the bridge valves 43 and 44 are then held closed by the springs 59.

In the case of a marked control departure, the magnetic valve 28 is energised. The control pressure P50 in the control pressure conduit 50 is therefore held at a low level. The blocking valve 36 can open under the influence of the pressure P33 in the conduit 33. The throttles 34 and 35 connected in parallel permit a relatively large supply of pressure medium to flow and thus facilitate a relatively rapid movement of the piston. When the control departure falls below a predetermined absolute value, the magnetic valve 28 is de-energised. The control pressure P50 occurs at its full value. The blocking valve 36 is closed. Only the throttle 34 is still open. The supply of pressure medium is therefore less and the piston moves more slowly until it is blocked by energisation of both magnetic valves 26 and 27.

FIG. 2 shows a modification where a magnetic valve 26' which is open in the rest position is disposed in the branch 51, whereas a throttle 52' is disposed in front of the branch in the control pressure conduit 48.

FIG. 3 shows a bridge valve 44'' on the supply side with a differential piston 57''. The closure ball 58 is held in the small piston portion **57*a* and the larger piston portion 57*b* is subjected to the control pressure. A spring can in this case be omitted. The chamber between the piston portions 57*a* and 57*b* is connected to the tank 2**.

The throttle arrangement 34, 35, 36 can also be downstream of the bridge circuit 38. A second pressure regulator can then serve to set the pressure P37. The downstream throttle 34 can also assume the function of the spring-biassed check valve 62.

We claim:

1. An electrohydraulic control assembly for controlling the operating direction of a bidirectional hydraulic work motor, comprising, a control valve unit including a motor controlling slide valve with pressure chambers on opposite sides thereof, neutral position springs and means in said chambers for maintaining said slide valve in a neutral position in the absence of unequal pressures in said chambers, said slide valve being selectively movable in opposite directions from a neutral position in response to pressure in either of said chambers for motor controlling purposes, a source of pressurized fluid and an exhaust tank, a hydraulic bridge circuit between said source and said tank having two supply branches connected to said source and two exhaust branches connected to said tank, pressure holding means between said exhaust branches and said tank for holding the bridge outlet pressure above atmospheric pressure, said bridge circuit having diagonally opposite ports between said supply and exhaust branches connected to said slide valve pressure chambers, valves having pressure operated chambers including a pressure operated supply valve in each supply branch and a pressure operated exhaust valve in each exhaust branch, said supply and exhaust valves being pressure operable to closed positions, pressure dissipation means between said pressure operated chambers of said exhaust valves and said tank to effect unloading of said exhaust valves in the absence of loading pressures, said exhaust valves having ball type closure elements, solenoid pilot valve means connected to respective pairs of said pressure operated chambers of said supply and exhaust valves to effect selective closing of said valves to selectively pressurize and exhaust said control valve unit chambers to cause said slide valve to move in a selected direction, said slide valve having rapid movement to a neutral position upon the deenergization of a respective pair of solenoid pilot valve means and the subsequent release of operating pressures in said bridge valves by the action of one of said neutral position springs causing said slide valve to move and force fluid from one of said chambers to the other through said bridge valves in said exhaust branches, and valve opening spring biasing means for each of said exhaust valves for rapidly overcoming said pressure holding and dissipation means to rapidly open said ball type closure elements thereof in the absence of a closing control pressure to avoid a cavitational action by preventing the closing of an exhaust valve due to a strong suction developed in one of said chambers as a result of said rapid movement of said slide valve.

2. A control assembly according to claim 1 wherein said bridge valves on the supply side of said bridge circuit have ball type closure elements which are biased in the closing direction by valve springs.

3. A control assembly according to claim 2 wherein said bridge valves include differential pistons of which the larger piston area is subjected to control pressure.

4. A control assembly according to claim 1 wherein said pressure holding means is formed by a counterpressure valve.

5. A control assembly according to claim 6 wherein each of said bridge valves has a cylindrical portion with first and second ports being axially and circumferentially located respectively, each of said bridge valves being adapted to close said first port of the corresponding one of said valves, and all of said bridge valves being arranged relative to said control valve pressure chambers so that said axially located ports of said bridge valves have direct fluid communication with said pressure chambers.

* * * * *